US007061437B2

(12) United States Patent
Lin et al.

(10) Patent No.: US 7,061,437 B2
(45) Date of Patent: Jun. 13, 2006

(54) PLANNER INVERTED-F ANTENNA HAVING A RIB-SHAPED RADIATION PLATE

(75) Inventors: Chin-Wen Lin, Tao-Yuan (TW); Shih-Chieh Lo, Taichung County (TW); Ho-Tsung Chang, Tao-Yuan Hsien (TW)

(73) Assignee: Syncomm Technology Corp., Hsin-Chu (TW)

( * ) Notice: Subject to any disclaimer, the term of this patent is extended or adjusted under 35 U.S.C. 154(b) by 0 days.

(21) Appl. No.: 10/906,326

(22) Filed: Feb. 15, 2005

(65) Prior Publication Data

US 2006/0097920 A1 May 11, 2006

(30) Foreign Application Priority Data

Nov. 4, 2004 (TW) ..... 93133648 A

(51) Int. Cl.
*H01Q 1/24* (2006.01)

(52) U.S. Cl. ..... 343/702; 343/700 MS; 343/795

(58) Field of Classification Search ..... 343/702, 343/700 MS, 795, 803, 824, 825, 829, 831, 343/845

See application file for complete search history.

(56) References Cited

U.S. PATENT DOCUMENTS

| | | | | |
|---|---|---|---|---|
| 5,550,554 | A * | 8/1996 | Erkocevic | 343/828 |
| 6,285,324 | B1 * | 9/2001 | Korisch et al. | 343/700 MS |
| 6,426,723 | B1 * | 7/2002 | Smith et al. | 343/700 MS |
| 6,618,014 | B1 * | 9/2003 | Stoiljkovic et al. | 343/702 |
| 6,624,786 | B1 * | 9/2003 | Boyle | 343/700 MS |
| 6,639,560 | B1 * | 10/2003 | Kadambi et al. | 343/700 MS |
| 2003/0234742 | A1 * | 12/2003 | Tai et al. | 343/700 MS |

* cited by examiner

*Primary Examiner*—Don Wong
*Assistant Examiner*—Marie Antoinette Cabucos
(74) *Attorney, Agent, or Firm*—Winston Hsu

(57) ABSTRACT

A planner inverted-F antenna (PIFA) includes a ground plane, a rib-shaped radiation plate installed approximately in parallel with the ground plane, a feeding line installed on the rib-shaped radiation plate, a feeding contact installed on an end of the feeding line, and a ground contact electrically connected to the ground plane.

7 Claims, 10 Drawing Sheets

| | PIFA 10 | PIFA 50 |
|---|---|---|
| X-Z | -3.4 | -2.72 |
| Y-Z | -5.58 | -4.03 |
| X-Y | -4.05 | -3.27 |

Unit : dBm

Fig. 9

| | PIFA 10 | PIFA 50 |
|---|---|---|
| X-Z | -4.65 | -6.88 |
| Y-Z | -3.5 | -0.86 |
| X-Y | -5.91 | -5.79 |

Unit : dBm

Fig. 10

PLANNER INVERTED-F ANTENNA HAVING A RIB-SHAPED RADIATION PLATE

BACKGROUND OF INVENTION

1. Field of the Invention

The present invention relates to a planner inverted-F antenna (PIFA), and more particularly, to a PIFA having a rib-shaped radiation plate.

2. Description of the Prior Art

The quality of an antenna is very important for a wireless communication system. A desirable installation of a proper and well-designed antenna on the wireless communication device can raise the value of the signal-to-noise ratio (SNR) of wireless signals, and can improve the bit error rate (BER) of the wireless signals.

Along with the development of wireless communication technologies, the integration of its device can be more and more compact. Accordingly, an embedded micro antenna has to be made as compact as possible so that can be successfully embedded into the wireless communication device. For example, a chip antenna and a planner antenna are two of the most popular micro antennas in the market. Both of the micro antennas have the characteristics of low profile and compact size. The planner antenna can be designed to have a variety of design patterns, such as a microstrip antenna, a printed antenna, and a planner inverted-F antenna (PIFA). Since the planner antenna has a strong sense of direction and a compact size and can be installed on a printed circuit board of the wireless communications device, the wireless communications device, with the planner antenna installed, is cheap.

Please refer to FIG. 1, which is a schematic diagram of a PIFA 10 according to the prior art. The PIFA 10 comprises a ground plane 12, a planner radiation plate 14 installed approximately in parallel with the ground plane 12, a feeding line 16 installed on the radiation plate 14, a feeding contact 18 located on an end of the feeding line 16, and a ground contact 20 electrically connected to the ground plane 12.

The PIFA 10 has a voltage standing wave ratio and a return loss changing in close relation with a position $(f_x,f_y)$ at which the feeding contact 18 feeds the ground plane 12, a width w of the radiation plate 14, and a distance h between the radiation plate 14 and the ground plane 12. Thus, most of the researches of the PIFA 10 focus on the adjustment of the position $(f_x,f_y)$, the width w, the distance h, or the shape of the radiation plate 14 so as to obtain an optimized receiving quality of the wireless signals.

Since the ground plane 12 and the radiation plate 14 are both thin metal plates of 0.3 mm only, an insulating material such as a sponge is inserted between the ground plane 12 and the radiation plate 14 to prevent the deformation of the radiation plate 14 by gravity or external force such that the distance h and the gain of the PIFA 10 can be constant.

However, the sponge will melt in the environment of high temperature due to the operation of the wireless communications device. In statistics, the sponge can survive one and a half years only. Moreover, since the sponge cannot survive in the high temperature environment, the high temperature reflow processes of a surface mount technology (SMT) or a wave soldering process cannot be utilized to install the PIFA 10 onto a printed circuit board but a soldering process by solder iron after the high temperature reflow process. Therefore, the manufacturing time and the cost are increased.

SUMMARY OF INVENTION

It is therefore a primary objective of the claimed invention to provide a PIFA with a rib-shaped radiation plate, which has a rigidity stronger than that of a planner radiation plate, and is not deformed even after a long time of use.

Another objective of the claimed invention is to provide a PIFA with a rib-shaped radiation plate. A high temperature reflow processes of a surface mount technology (SMT) or a wave soldering process can therefore be utilized to install the PIFA onto a printed circuit board instead of a soldering process by solder iron after the high temperature reflow process. Therefore, the manufacturing time and the cost are decreased.

According to the claimed invention, the PIFA includes a ground plane, a rib-shaped radiation plate installed approximately in parallel with the ground plane, the rib-shaped radiation plate comprising a rib, a feeding line installed on the rib-shaped radiation plate, a feeding contact located on an end of the feeding line, and a ground contact electrically connected to the ground plane.

According to the preferred embodiment, the ground plane is electrically connected to a ground area in a printed circuit board, the rib-shaped radiation plate has a line-shaped rib, the line-shaped rib extends from one edge to the other of the rib-shaped radiation plate, and the rib-shaped radiation plate has a cross section having the shape of an open rectangle, a "V" character, or a semicircle.

It is an advantage of the claimed invention that a PIFA with the rib-shaped radiation plate is not easy to be deformed by gravity or external force. Moreover, the installation of the rib does not degrade but improve the average gains of the PIFA. Further, the PIFA according to the present invention can be installed onto a printed circuit board through an SMT or a wave soldering processes, and the time and the cost of manufacturing a PIFA is therefore reduced.

These and other objectives of the present invention will no doubt become obvious to those of ordinary skill in the art after reading the following detailed description of the preferred embodiment that is illustrated in the various figures and drawings.

BRIEF DESCRIPTION OF DRAWINGS

FIG. 9 is a comparison diagram of horizontal average gains of the PIFAs shown in FIG. 1 and FIG. 2 toward an X-Z, a Y-Z, and an X-Y direction respectively when operating in 2440 MHz; and FIG. 10 is a comparison diagram of vertical average gains of the PIFAs shown in FIG. 1 and FIG. 2 toward an X-Z, a Y-Z, and an X-Y direction respectively when operating in 2440 MHz.

DETAILED DESCRIPTION

Figure 2:
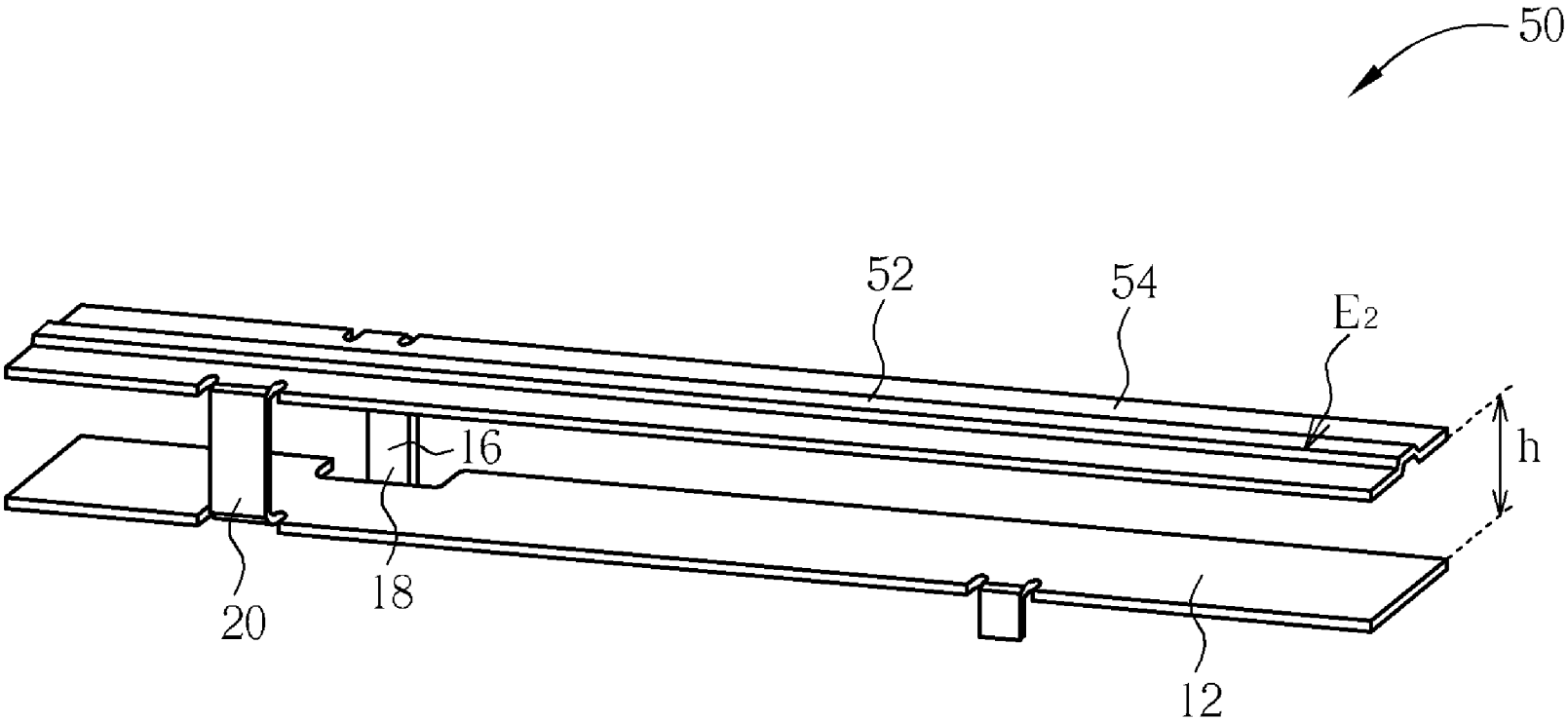
FIG. 2 is a schematic diagram of a PIFA of the preferred embodiment according to the present invention.

Please refer to FIG. 2, which is a schematic diagram of a PIFA 50 of the preferred embodiment according to the present invention. In addition to the ground plane 12, the feeding line 16, the feeding contact 18, and the ground contact 20, the PIFA 50 further comprises a rib-shaped radiation plate 54. In contrast with the planner radiation plate 14 described in the prior art, the rib-shaped radiation plate 54 has a non-planner structure. In detail, the rib-shaped radiation plate 54 comprises a rib 52. Through the molding of the rib 52 on the radiation plate, a better rigidity of the shaped radiation plate is performed.

Figure 1:
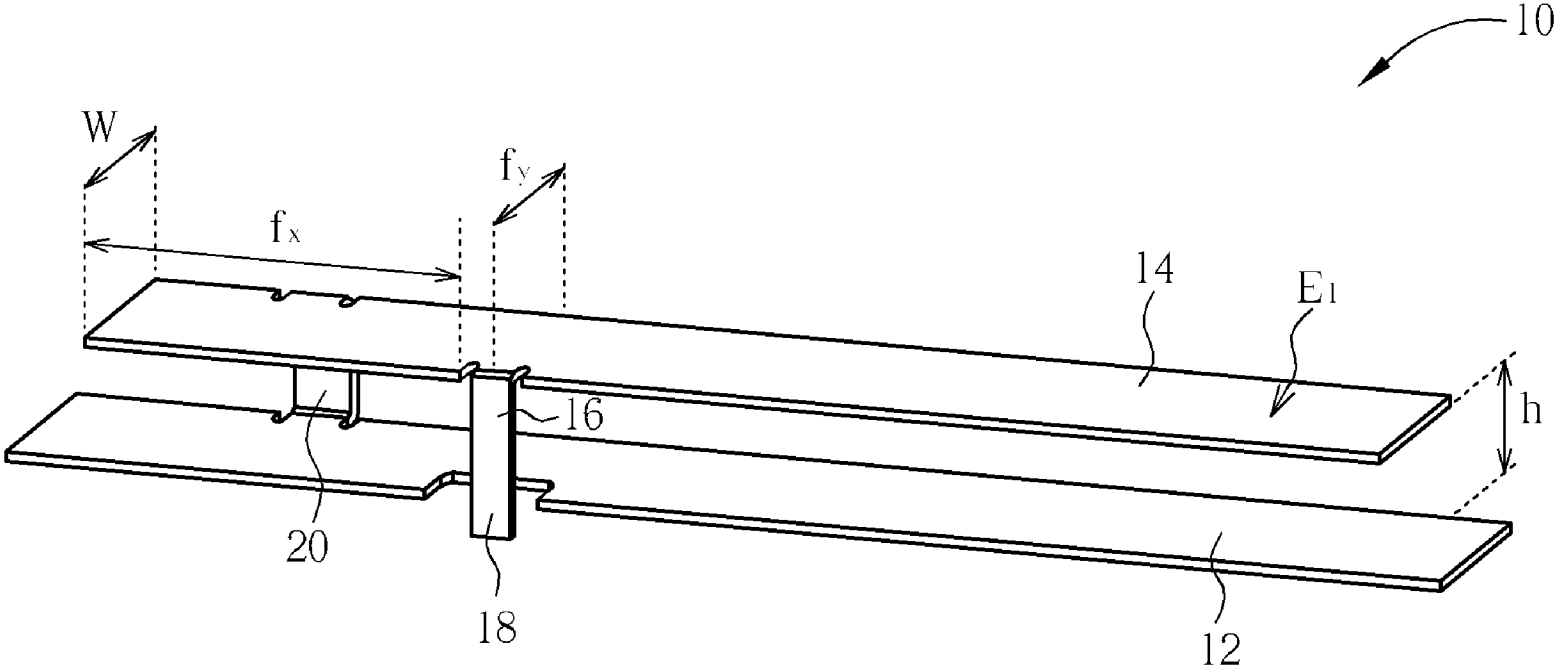
Fig. 1 Prior art
FIG. 1 is a schematic diagram of a PIFA according to the prior art.
Figure 3:
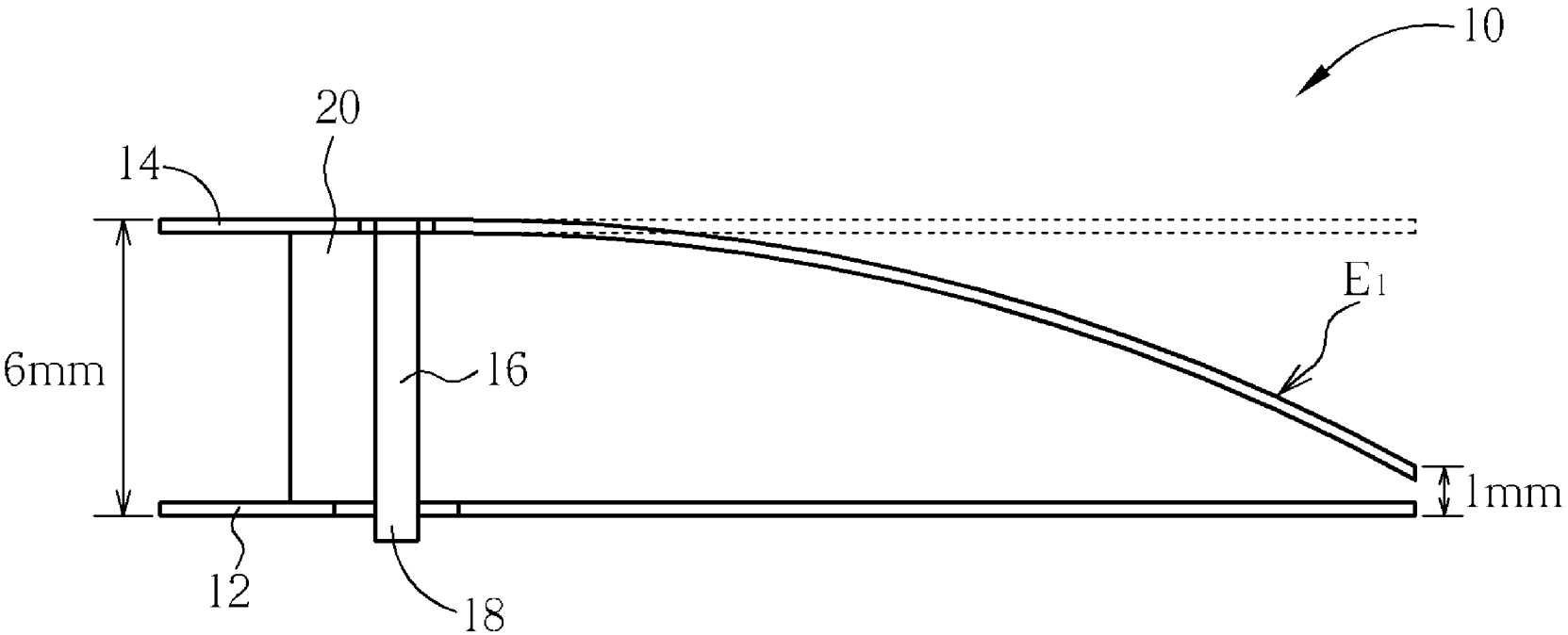
FIG. 3 is a side view of the PIFA shown in FIG. 1 when a 100 gw external force is applied on an end of the PIFA.
Figure 4:
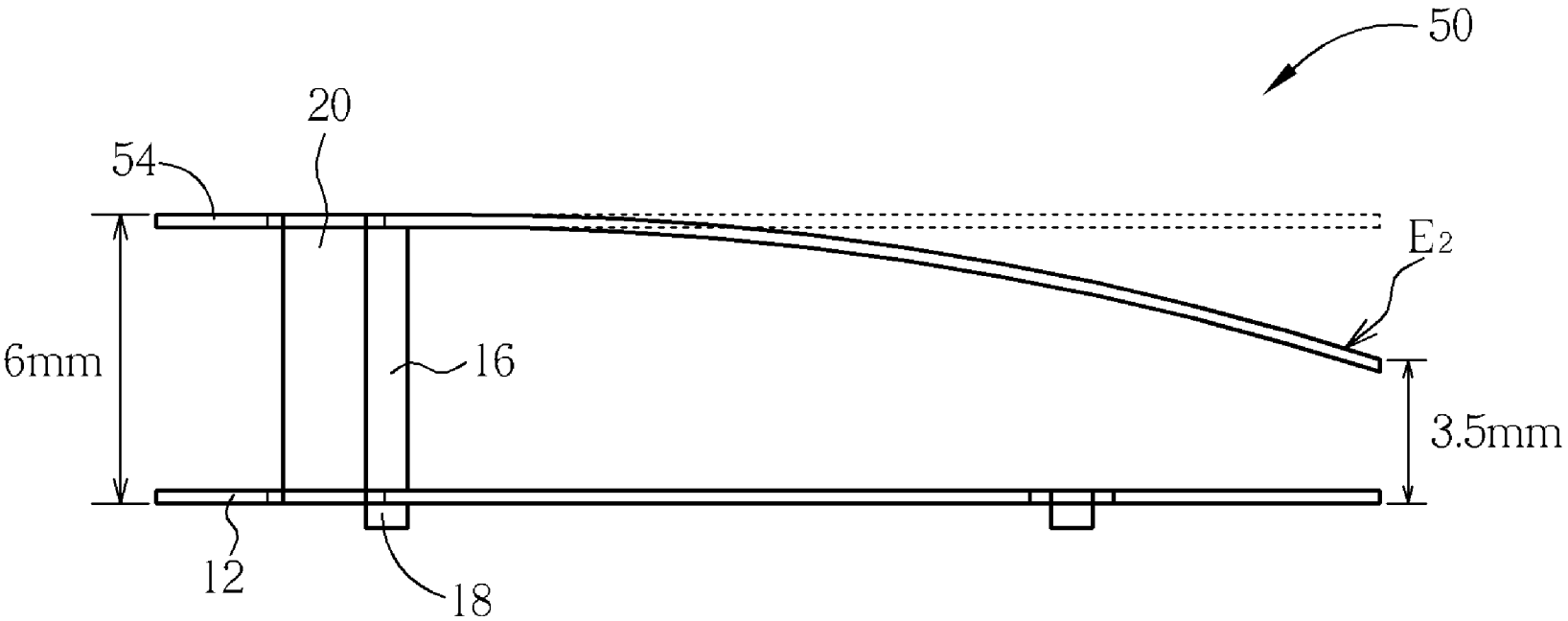
FIG. 4 is a side view of the PIFA shown in FIG. 2 when the 100 gw external force is applied on an end of the PIFA.

Please refer to FIG. 1 and FIG. 2. The distance h between the planner radiation plate 14 and the ground plane 12, and the distance h between the rib-shaped radiation plate 54 and the ground plane 12 are both equal to 6 mm. After an 100 gw external force is applied on an end indicated by arrow $E_1$ of the planner radiation plate 14, as shown FIG. 3, the end of the planner radiation plate 14 is fallen by 5 mm and the distance h is reduced to 1 mm. Similarly, as shown in FIG. 4, after the 100 gw external force is applied on an end indicated by arrow $E_2$ of the rib-shaped radiation plate 54, the end of the rib-shaped radiation plate 54 is fallen by 2.5 mm and the distance h is reduced to 3.5 mm. It is apparent that the rib-shaped radiation plate 54 of the PIFA 50 has a better rigidity than that of the prior art.

Please refer to FIG. 9 and FIG. 10, which show the comparison diagrams of the horizontal and vertical average gains of the PIFA 10 and the PIFA 50 toward an X-Z, a Y-Z, and an X-Y direction respectively when operating in 2440 MHz. As shown in FIG. 9 and FIG. 10, the average gains of the PIFA 50 are all higher than that of the prior art except the X-Z directional vertical average gain. In conclusion, in addition to the improvement of rigidity, the installation of the rib 52 on a planner radiation plate to form the rib-shaped radiation plate 54 does not degrade but improve the average gains of the PIFA 50.

Figure 5:
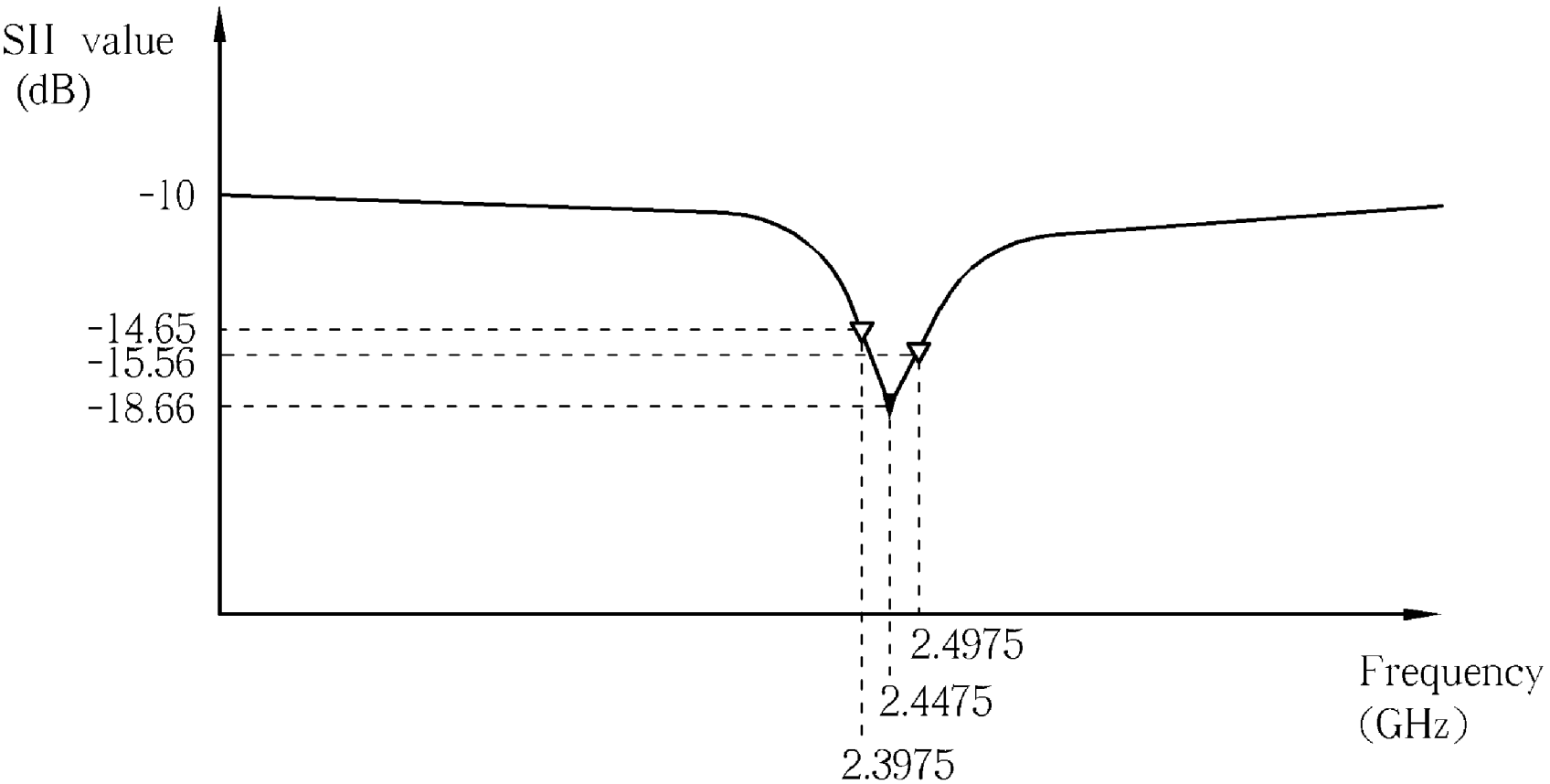
FIG. 5 is a characteristic curve for S11 values corresponding to the operating frequencies of the PIFA shown in FIG. 2.

Besides the average gains, the S11 VS. frequency characteristic curve is also very important to the performance of an antenna. Please refer to FIG. 5, which is a characteristic curve of the operating frequencies and the antenna S11 values, where the Y-axis is the S11 values and the X-axis is the frequencies. As shown in FIG. 5, when the PIFA 50 is operating in a channel of 2.3975 GHz, 2.4475 GHz, and 2.4975 GHz, which is within WLAN 802.11b and 802.11g band, the S11 values are −14.65 dB, −18.66 dB, and −15.56 dB respectively. And all are better than acceptable level, −10 dB.

Figure 6:
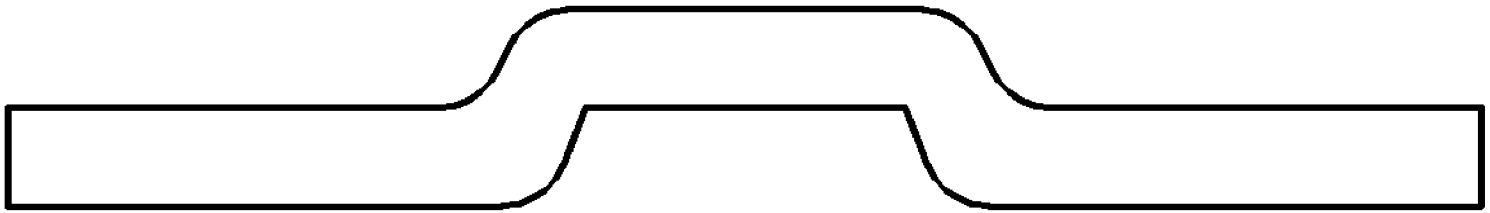
FIG. 6 to FIG. 8 are three cross sectional diagrams of a rib-shaped radiation plate of the PIFA shown in FIG. 2.
Figure 7:
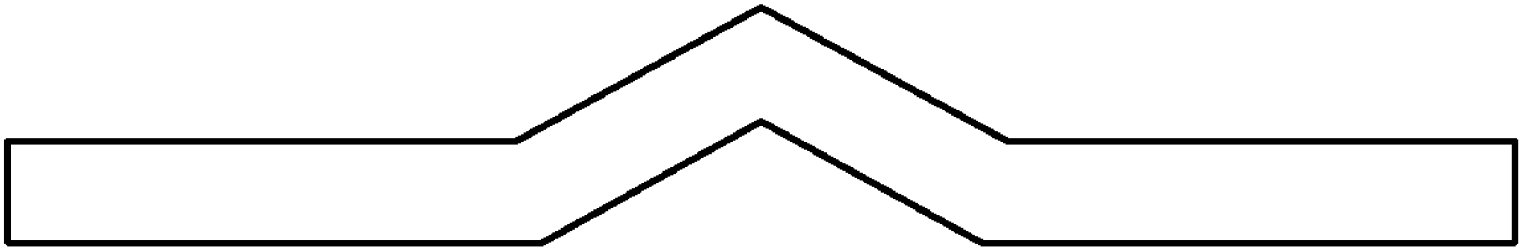
Figure 8:
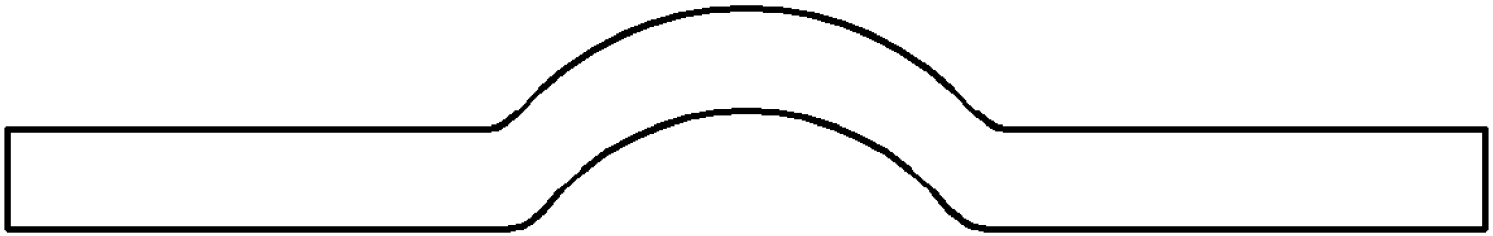

According to the preferred embodiment, the rib-shaped radiation plate 54 can have a cross section of a variety of shapes, for example the shapes of an open rectangle shown in FIG. 6, of a "V" character shown in FIG. 7, and of a semicircle shown in FIG. 8. The rib 52 can be of any shape, for example a straight line shown in FIG. 2, and the two ends of the rib 52 can selectively contact to the edges of the rib-shaped radiation plate 54, for example, as shown in FIG. 2, the length of the rib 52 is equal to that of the radiation plate 54.

As mentioned previously, since the PIFA 50 can be installed onto a printed circuit board, the PIFA 50 can be grounded to the grounded area of the printed circuit board.

In contrast to the prior art, the present invention can provide a PIFA with a rib-shaped radiation plate. Without the need of any additional processes, the rib-shaped radiation plate manufactured through a molding of a rib on a planner radiation plate has a better rigidity than that of the prior art. Moreover, the installation of the rib does not degrade but improve the average gains of the PIFA. Further, the PIFA according to the present invention can be installed onto a printed circuit board through an SMT or a wave soldering process, and the time and the cost of manufacturing a PIFA is therefore reduced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A planner inverted-F antenna (PIFA) comprising:

a ground plane;

a rib-shaped radiation plate installed approximately in parallel with the ground plane, the rib-shaped radiation plate comprising a rib;

a feeding line installed on the rib-shaped radiation plate;

a feeding contact located on an end of the feeding line; and a ground contact electrically connected to the ground plane.

2. The PIFA of claim 1, wherein the ground plane is electrically connected to a grounded area of a printed circuit board.

3. The PIFA of claim 1, wherein the rib-shaped radiation plate comprises a line-shaped rib.

4. The PIFA of claim 3, wherein the line-shaped rib extends from one edge to the other of the rib-shaped radiation plate.

5. The PIFA of claim 3, wherein the rib-shaped radiation plate has a cross section having the shape of an open rectangle.

6. The PIFA of claim 3, wherein the rib-shaped radiation plate has a cross section having the shape of a "V" character.

7. The PIFA of claim 3, wherein the rib-shaped radiation plate has a cross section having the shape of a semicircle.

* * * * *